United States Patent [19]

Lee

[11] Patent Number: 4,809,975

[45] Date of Patent: Mar. 7, 1989

[54] GOLF CLUB SWING TRAINER

[76] Inventor: Boyong Lee, 1935 Rosalia Rd., Los Angeles, Calif. 90027

[21] Appl. No.: 745,531

[22] Filed: Jun. 17, 1985

[51] Int. Cl.[4] ..... A63B 15/00

[52] U.S. Cl. ..... 272/128; 272/124; 273/193 A

[58] Field of Search ..... 272/124, 117, 93, 119, 272/128, 143; 273/193 A, 26 B

[56] References Cited

U.S. PATENT DOCUMENTS

| | | | |
|---|---|---|---|
| 647,220 | 4/1900 | Coortney | 272/124 |
| 3,414,260 | 12/1968 | Gost | 273/29 A X |
| 3,428,325 | 2/1969 | Atkinson | 273/26 B X |
| 4,098,503 | 7/1978 | Antone | 273/26 B |
| 4,274,631 | 6/1981 | Hayazaki | 273/26 B |
| 4,302,008 | 11/1981 | Lard | 272/124 X |
| 4,444,396 | 4/1984 | Wendt | 272/124 X |

*Primary Examiner*—Richard J. Apley
*Assistant Examiner*—R. Bahr
*Attorney, Agent, or Firm*—Julius Rubinstein

[57] ABSTRACT

The exerciser includes a shaft. A weight is slidably mounted on the shaft. A golf club handle is formed at one end of the shaft and a stop is formed at the end of the shaft remote from the handle. A coil spring is mounted between the slidably mounted weight and the stop on the end of the shaft when the exerciser is swung. The slidably mounted weight is heavy enough so that when the exerciser is swung the person using it can feel the increased torque in the exercise caused by the movement of the weight down the shaft whereby the person using the exerciser can learn the feel of a correct golf swing.

20 Claims, 2 Drawing Sheets

GOLF CLUB SWING TRAINER

This invention relates generally to an exerciser and more particularly to a device for developing a slow, smooth, and tension free golf swing.

A. BACKGROUND AND BRIEF SUMMARY

The ultimate objective of a good golf swing is to strike the ball a longer distance in a correct direction. In order to achieve this objective, a player must develop a slow and smooth back-swing, and an effortless down-swing producing the maximum club head speed at the impact of the ball.

Golfers having problems with their golf swing tend to relate the distance the ball travels to the power and effort applied to the golf club, rather than speed and motion. But in trying to create power, such golfers create tension in their arms which actually slows down their golf swing.

Freedom from tension requires a relaxed swinging motion and a light grip pressure. But when the golfer applies power and effort to the golf club during the golf swing, he exerts too strong a grip pressure on the golf club which creates more tension. In addition the strong grip pressure prevents the golfer from learning the feel of a correct golf swing.

Overcoming these problems is not easy to achieve. In the past, many training devices have been developed to help the golfer improve his swing. In general, these prior devices involved mechanisms more or less shaped like a golf club which relied on centrifugal force to excite a mechanism which made a noise when the golf was swung with the correct speed. The idea was to find out if the golf club head achieved the correct speed when it struck the golf ball.

One of these prior training devices is exemplified by the patent of Blake U.S. Pat. No. 190 2,772,887. This device, like the present invention, was designed to be used in confined space such as an office or a room in a house. It comprised a short length shaft with a golf club handle at one end. When the device was swung at the correct speed, a washer-like piece, mounted on the shaft was released and moved down the shaft to strike a stop making a clicking sound.

Other devices of this type are disclosed in the patents to Strahan U.S. Pat. No. 3,362,356, Zordan U.S. Pat. No. 3,137,504, Hayozaki U.S. Pat. No. 4,274,631, Hurzan U.S. Pat. No. 2,950,115, Katsube U.S. Pat. No. 4,027,886, and a patent to Strumph U.S. Pat. No. 2,223,647. These patents work on the same principle as the patent to Blake but differ only in the mechanism used to make the desired sound when the device is swung at the correct speed.

These devices all required a conscious exertion of muscular strength for the power and effort applied to the training device during a practice swing to achieve the correct golf club speed at the proper point in the golf swing. This arrangement was counter-productive because they created tension and because they tired the arm muscles. This made the golf swing erratic so that the golfer never learned the feel of a correct golf swing.

The present invention is an expression of a new approach in the development of an improved golf swing. It relies on the technique of patterning. This is a procedure used in physiotherapy that is designed to improve nervous control of muscles by means of feed-back from muscular activity imposed by an outside source or induced by other muscles.

In the present invention the exerciser is designed to eliminate tension and to produce maximum speed at impact with the ball by causing the exerciser when swung correctly to transmit to the arm muscles the sensation of a correct golf swing. The exerciser comprises a short length shaft with a golf club handle at one end. A weight is slidably mounted on the shaft. A coil spring is mounted between the end of the shaft and the slidably mounted weight. Its function is to control the speed of the weight down the shaft when the exerciser is swung.

As the golfer swings the exerciser, centrifugal forces cause the slidably mounted weight to move down the shaft compressing the spring. The weight must be heavy enough so that as it moves down the shaft, the torque exerted by the weight increases enough to accelerate the device without exertion by the golfer. This eliminates the tendency of the golfer to exert power and effort during the swing thereby training the golfer to avoid developing tension in his arms. Moreover, the slidably mounted weight is heavy enough so that as it moves down the shaft, the acceleration of the device caused by increased torque without exertion by the golfer can be felt in the arms of the golfer thus creating the sensation of a correct golf swing. The exerciser must be swung so this weight reaches the bottom of the shaft when the golf club reaches its maximum speed at the point in the swing when the golf club would strike the golf ball. The exerciser has means for varying the compression in the spring to accommodate variations in body characteristics.

As the golfer continues practicing with the exerciser, the sensation imparted to the muscles of the arm is learned by the mind which helps improve the control of the arm muscles. Moreover, since the increase in acceleration of a device is caused by the movement of the weight down the shaft, with the increasing torque, the muscles of the arm are not strained by practicing, so that practice with the exerciser is not tiring and tension is eliminated. In addition, the left hand and arm are strengthened by repetitive swings with the exerciser and these muscles are trained to produce maximum speed of the club head at impact with the ball without extra exertion.

As stated above, it is essential that the golfer use a light grip pressure when holding a golf club. However, this exerciser has a shaft length which is shorter than the conventional golf club because it is designed to be used in an office or a room in the house. In such an environment, holding the exerciser with a light grip could be dangerous because it could slip out of the golfer's hands causing injury and damage. To prevent this from happening, persons using the exerciser tend to grasp the handle with extra strength. However, this creates tension in the arms which slows the golf swing and is counter-productive. To prevent the tendency of the golfer to hold the handle with a tight grip, a strap is attached to the hands of the golfer and to the handle of the exerciser. This prevents the device from slipping out of the golfer's hands. Consequently, the golfer has the confidence to practice with the exerciser holding it with a light grip.

What is needed therefore, and comprises an important object of this invention, is to provide an exerciser that transmits the sensation of a correct golf swing to the arms of the golfer thereby training the muscles of the arms to groove the swing path in a limited area and to produce maximum speed of the golf club head at the moment of the impact with the ball.

Another object of this invention is to provide a training device which can be used in a confined area and which eliminates the tendency of the user to grip the device tightly.

These and other objects of this invention will become more apparent when better understood in light of the accompanying drawings and specifications wherein:

FIG. 1 is a perspective view of the exerciser constructed according to the principles of this invention.

FIG. 2 discloses the movement of the weight and the compression of the spring in the exerciser as it moves towards the bottom of the shaft when the exerciser is swung like a golf club.

Figure 1:
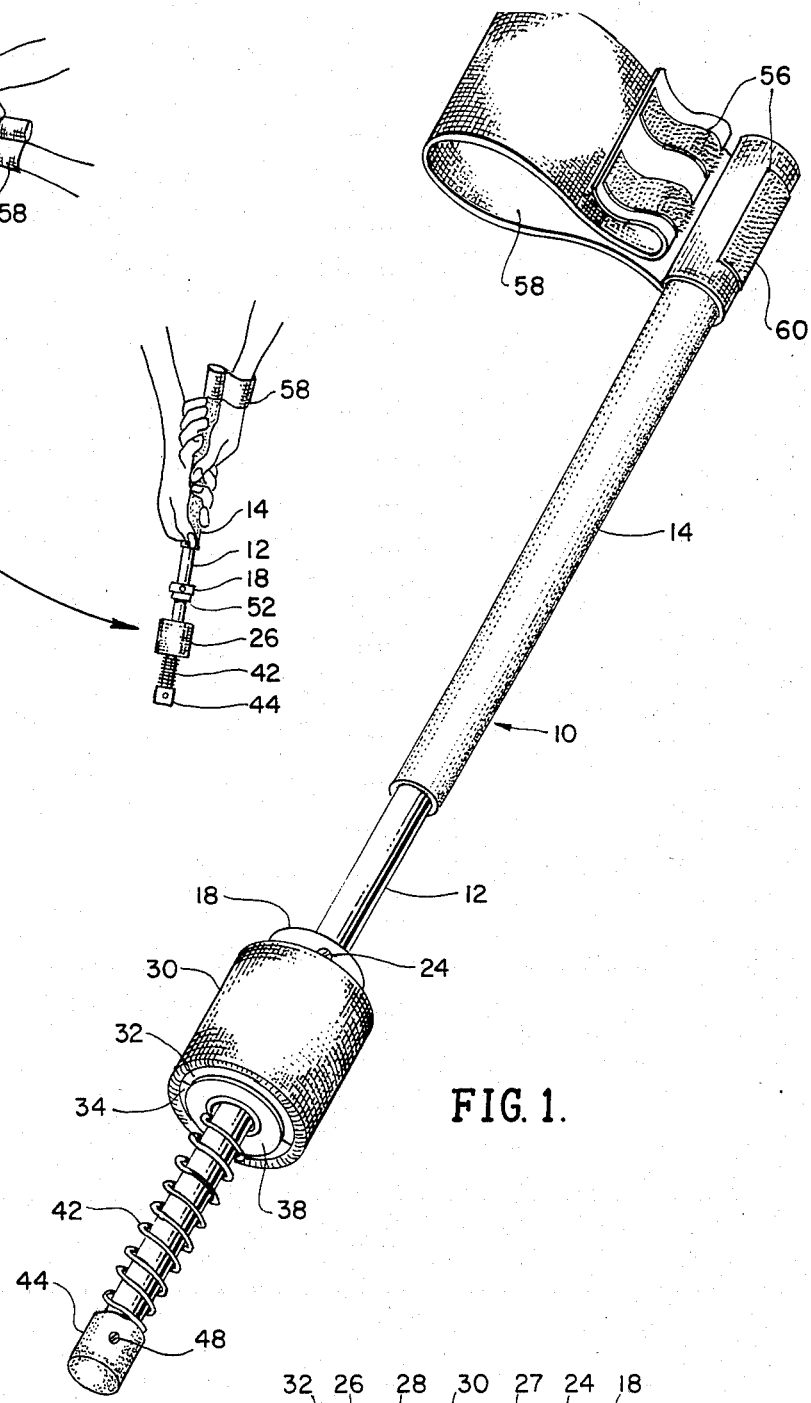

Referring now to FIG. 1 of the drawing, the exerciser indicated by the reference numeral 10 comprises a tubular shaft 12 which is substantially shorter than the length of the regulation golf club. A handle 14 shaped like a golf club handle is formed at one end of the shaft. A series of longitudinally spaced bolt receiving openings 16, extending through the shaft 12 are formed intermediate the ends of the shaft, see FIG. 3.

A cylindrical stop 18 is provided with a longitudinal shaft receiving opening 20 extending therethrough. The opening is sized to receive the shaft 12, see FIG. 3. In this way the stop can be mounted on the shaft. The stop 18 is also provided with a bolt receiving opening 22, extending diametrically through the stop. A suitable bolt 24 extends through opening 22 in the stop and one of the openings 16 in the shaft to fix the position of the stop on the shaft.

A cylindrical weight 26 having longitudinally extending opening 28 sized to receive the shaft 12 is slidably mounted on the shaft. The weight 26 is embraced by an elastic retaining sleeve 30 formed from some suitable fabric. The weight 26 can be augmented, in accordance with the needs of the user, by adding one or more pairs of semi-circular weights 32 and 34, see FIGS. 3 and 4. These semi-circular weights have a concentric semi-circular recess 36 slightly larger in diameter than the diameter of the shaft 20 and are mounted on the shaft with the semi-circular recesses facing each other and embracing the shaft 12, see FIGS. 3 and 4.

Figure 3:
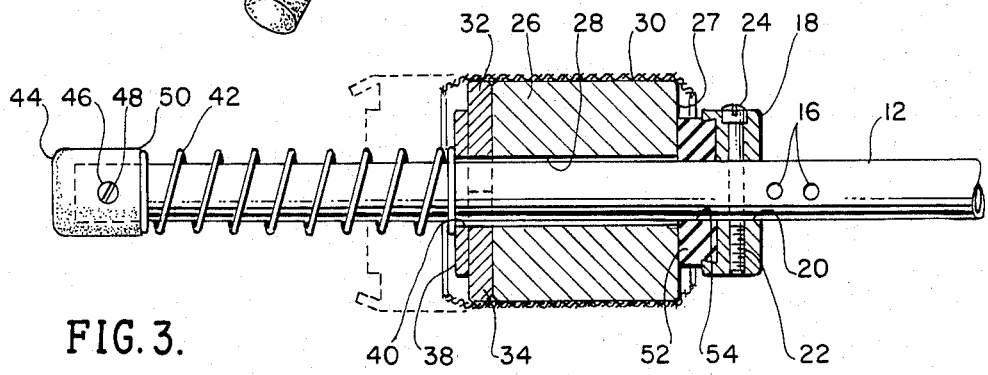
FIG. 3 is an elevational view partly in section of a portion of the exerciser showing details of its construction, and showing, in dotted lines, the movement of the weight towards the end of the exerciser at the downward part of the golf swing.
Figure 5:
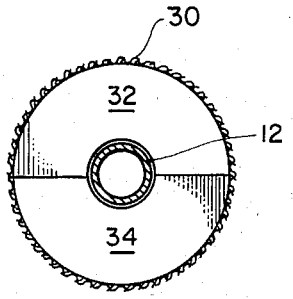
FIG. 5 is a cross-sectional view of the slidable weight with the attached semi-circular weights retained by the surrounding elastic sleeve.
Figure 4:
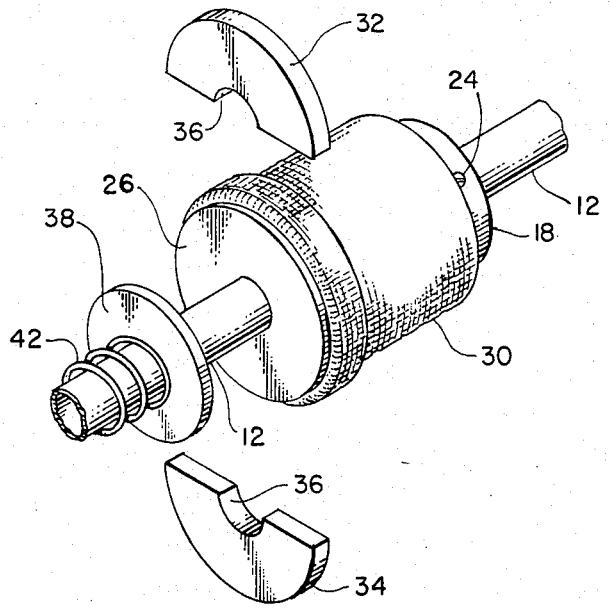
FIG. 4 is a pespective view of the slidable weight showing a pair of semi-circular weights that can added to the fixed weight.

The axial length of the elastic retaining sleeve covering the slidable weight 26 is graeter than the axial length of the slidable weight 26 to accommodate and hold in position additional pairs of semi-circular weights 32 and 34. FIG. 3 shows a pair of semi-circular weights 32 and 34 embraced by the elastic sleeve 30 abutting the end of the slidable weight 26. In addition, a washer 38 with a centrally disposed circular shaft receiving opening 40 abuts the flat faces of the weights 32 and 34 to hold them in the elastic sleeve, see FIG. 3.

A coil spring 42 is mounted on the shaft 12. An end cap or stop 44 preferably formed from some rubber like material is mounted on the end of the shaft 12. In this way, spring 42 is compressed between the flat face 50 of the end cap 44 and the slidable weight 26.

A bolt receiving opening 46 extends diametrically through the end cap 44 and is aligned with an opening formed at the end of the shaft 12. In this way, by inserting a bolt 48 through openings 46 and the opening at the end of shaft 12, the end cap 44 can be mounted on the end of shaft.

A suitable shock absorbing rubber like washer 52 with a longitudinal shaft receiving opening 54 extending therethrough, is mounted on the end of the shaft 12 and abuts against the stop 18 and the facing surface 27 of the weight 26, see FIG. 3.

A velcro strap 56 is attached by any suitable means such as gluing to the end of handle 14. The velcro strap can be folded into a wrist receiving loop 58. The size of the loop can be varied to accommodate difference wrists by attaching different portions of the velcro strap to the portion of the velcro strap attached to the portion 60 of the strap secured to handle 14.

Figure 2:
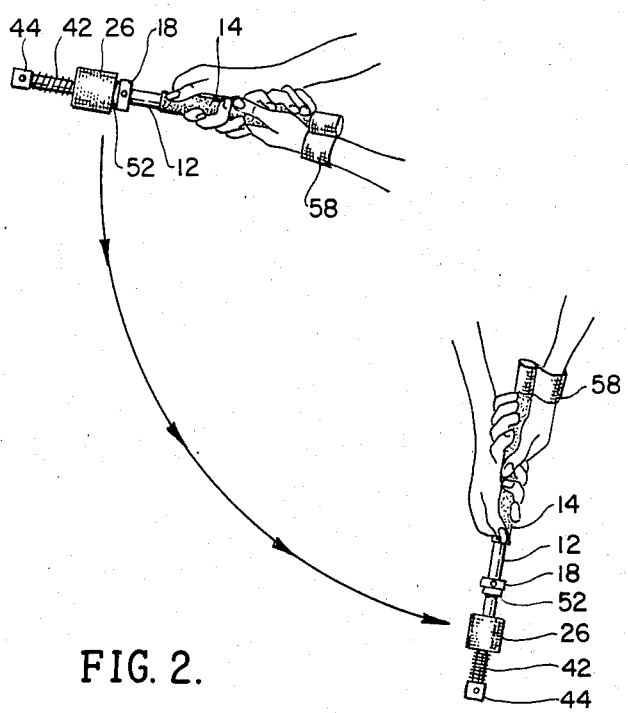

In use, the hands of a person using the exerciser is inserted through the properly adjusted loop 58. This pemits the handle 14 to be gripped lightly without fear of the exerciser slipping out of the hands of the person using it. Consequently, tension is avoided. When the exerciser is raised to the upper position, shown in FIG. 2, at the beginning of the golf stroke, the weight 26 with any pairs of semicircular weights 32 and 34 attached to it, moves under the force of gravity until it abuts the shock absorbing washer 52 and stop 18. Then as the arms of the exerciser move through a golf swing, the centrifugal force on the exerciser caused by the weight 26 gradually overcomes the resistance of spring 42 so that the weight moves down the shaft until at the bottom of the stroke, weight 26 abuts face 50 of the end cap 44.

If the golf swing is correct the golf club must be swung to produce the maximum speed of the club head at the moment of impact with the ball. In the exerciser, the weight 26 must reach the stop or end cap 44 at the point in the swing where the club head would strike the ball. The control of the speed of the weight down the shaft is achieved by the coil spring 42. If the coil spring has the correct compression for the user, the weight 26 would move down the shaft 12 at the correct speed and strike the end cap 44 at the point in the golf swing where the club head would strike the ball.

Since the physical characteristics of persons using the exerciser vary substantially, an adjustment is provided to change the compression of the spring. This is achieved by the series of opening 16 extending to the shaft 12. In this way, the position of the stop 18 can be adjusted on the shaft. This adjustment varies the compression of spring 42 thereby influencing the movement of the weight 26 down the shaft. As stated above, the weight 26 must be large enough so that its movement down the shaft can be felt by the person using the exerciser. Since people vary in sensitivity, the magnitude of weight 26 can be adjusted by insertng one or more pairs of weights 32 and 34 in the elastic sleeve 40 to increase the sensation imparted to the arms of the person using the exerciser. In addition, the variation in weight 26 provides another means for controlling the speed of the weight down the shaft. The effect of spring 42 is to control the movement of the weight down shaft 20, so that despite the short length of the shaft 12, the weight gradually moves down the shaft as the centrifugal force increases.

The loop 58 which extends through the hand of person using the exerciser is very important. This is because a person using the exerciser can grip the device just like he grips an ordinary golf club. Too tight a grip creates tension in the left arm which slows down swing motion. Too loose a grip could permit the exerciser to slip out of the hands of the user, and strike someone causing damage and possible injury. Since this exerciser is designed to be used in confined spaces, a person using the exerciser without the safety afforded by the strap 58, and conscious that if the exerciser slipped through his hands, it could strike someone and cause damage and injury, would tend to grip the handle harder than he would with a regular golf club, thereby increasing tension. But this would slow the golf swing and tire the muscles of the hands and the arm. The use of the strap prevents this tendency so that the user does not grip the club tighter than he would with an ordinary golf club. Consequently, use of this exerciser more closely simulates the feel of an ordinary golf club and develops the muscles in accordance with the proper feel of the golf club.

In summary, a correct golf swing requires the golf club to accelerate smoothly during the swing until the club strikes the ball. When this exerciser is used, the weight gradually moves down the shaft without any extra effort by the person using the device. As the weight moves down the shaft, the torque or force exerted by the device on the arms of the person using the exerciser gradually increases, the way it would when a golf club is swung correctly. This force imparts to the arms of the person using the exerciser, the sensation of a correct golf swing. Moreover, as stated above, the movement of the weight down the shaft which causes this sensation is achieved without power and effort applied by the user of the exerciser, thereby eliminating tension. After the user practices with this device a number of times, the sensation imparted to the muscles of the arms is learned by the mind and this helps improve the control of the arm muscles during the golf swing.

Having shown and described this invention what I claim as new is:

1. A golf club swing trainer for training arm muscles to improve a golf swing comprising a truncated golf club shaft, a weight slidably mounted on the shaft, a golf club handle formed on one end of the shaft, resistance means on the shaft for regulating the speed of said weight toward the end of the shaft remote from the handle when the swing trainer is swung, the magnitude of the slidably mounted weight sufficiently large so when the swing trainer is swung like a golf club, the sensation of increased torque caused when centrifugal force causes the weight to move down the shaft, can be felt in the arms of the person using the device, whereby the person using the swing trainer learns the feel of a correct golf swing.

2. The trainer described in claim 1 including means for varying the speed of the weight down the shaft when the exerciser is swung.

3. The trainer described in claim 1 including means for preventing the exerciser from slipping out of the hands of the person swinging it, whereby the exerciser can be held with a light grip.

4. The trainer described in claim 1 including means for varying the magnitude of said weight slidably mounted on the shaft, whereby the speed of the weight down the shaft can be varied when the exerciser is swung.

5. A golf club swing trainer for training arm muscles to improve a golf swing comprising a truncated golf club shaft, a weight slidably mounted on the shaft, a golf club handle formed on one end of the shaft, a stop on the shaft to limit the movement of the weight towards the handle, a limit stop at the end of the shaft remote from the handle, a coil spring mounted on the shaft, the ends of the coil spring abutting the weight and the stop at the end of the shaft remote from the handle, the magnitude of the slidably mounted weight sufficiently large so when the swing trainer is swung like a golf club the sensation of increased torque caused when centrifugal force acting on the weight overcomes the resistance offered by the coil spring causing the weight to slide down the shaft, can be detected in the arms of the person using the device whereby the person using the device learns the feel of a correct swing.

6. The trainer described in claim 5 including means for varying the compression of said coil spring whereby the speed of the weight down the shaft can be varied when the exerciser is swung.

7. The trainer described in claim 6 wherein said means for varying the compression of the coil spring comprises means for changing the position of the limit stop on the shaft whereby the compression of the coil spring abutting the stop at the end of the shaft and the slidably mounted weight can be varied.

8. The trainer described in claim 5 including means for varying the magnitude of said weight slidably mounted on the shaft whereby the speed of the weight down the shaft can be varied when the exerciser is swung.

9. The trainer described in claim 5 including means for preventing the exerciser from slipping out of the hands of the person swinging it, whereby the exerciser can be held with a light grip.

10. The trainer described in claim 9 wherein said means for preventing the exerciser from slipping out of the hands of a person swinging it comprises a strap in the form of a loop attached to the handle of the exerciser, whereby when the hand of a person using the exerciser extends through said loop, the person swinging the exerciser can grasp it lightly.

11. A golf club swing trainer for training arm muscles to improve a golf swing comprising a truncated golf club shaft, a weight slidably mounted on the shaft, a golf club handle formed on one end of the shaft, a limit stop on the shaft to limit the movement of the weight towards the handle, a stop at the end of the shaft remote from the handle, a coil spring for regulating the speed of the weight toward the end of the shaft remote from the handle when the swing trainer is swung, mounted on the shaft, the ends of said coil spring abutting the stop on the end of the shaft and said weight, the resistance of the coil spring and the magnitude of the slidably mounted weight chosen so when the swing trainer is swung like a golf club the sensation of increased torque caused when the weight slides down the shaft can be felt in the arms of the person using the exerciser, whereby the person using the golf club swing trainer learns the feel of a correctly swung golf club.

12. The trainer described in claim 11 including means for varying the speed of the slidably mounted weight down the shaft when the exerciser is swung.

13. The trainer described in claim 11 including means for varying the magnitude of the slidably mounted weight on the shaft whereby the speed of said weight down the shaft can be varied when the exerciser is swung.

14. The trainer described in claim 11 including means for preventing the exerciser from slipping out of the hands of the person swinging it, whereby the exerciser can be held with a light grip.

15. The trainer described in claim 14 wherein said means for preventing the exerciser from slipping out of the hands of a person swinging it comprises a strap in the form of a loop attached to the handle of the exerciser, whereby when the hand of a person using the exerciser extends through said loop, the person swinging the exerciser can grasp it lightly.

16. The trainer described in claim 11 including means for varying the compression of said coil spring whereby the speed of the slidably mounted weight down the shaft can be varied when the exerciser is swung.

17. The trainer described in claim 16 wherein said means for varying the compression of the coil spring comprises means for changing the position of the limit stop on the shaft whereby the compression of the coil spring abutting the stop at the end of the shaft and the slidably mounted weight can be varied.

18. A golf club swing trainer for training arm muscles to improve a golf swing comprising a truncated golf club shaft, a weight slidably mounted on the shaft, a golf club handle formed on one end of the shaft, resistance means on the shaft for regulating the speed of said weight toward the end of the shaft remote from the handle when the swing trainer is swung, the magnitude of the slidably mounted weight sufficiently large so when the swing trainer is swung like a golf club, the sensation of increased torque caused when centrifugal force causes the weight to move down the shaft, can be felt in the arms of the person using the device, whereby the person using the swing trainer learns the feel of a correct golf swing, and means for varying the magnitude of said weight slidably mounted on the shaft, whereby the speed of the weight down the shaft can be varied when the trainer is swung, said means for varying the magnitude of the slidably mounted weight on the shaft comprising a sleeve formed from an elastic fabric covering the slidably mounted weight, the length of the sleeve larger than the length of said slidably mounted weight, and additional weights removably mounted in said sleeve embracing said shaft and held in said embrace by said sleeve for increasing the magnitude of the slidably mounted weight on said shaft.

19. A golf club swing trainer for training arm muscles to improve a golf swing comprising a truncated golf club shaft, a weight slidably mounted on the shaft, a golf club handle formed on one end of the shaft, a stop on the shaft to limit the movement of the weight towards the handle, a limit stop at the end of the shaft remote from the handle, a coil spring mounted on the shaft, the ends of the coil spring abutting the weight and the stop at the end of the shaft remote from the handle, the magnitude of the slidably mounted weight sufficiently large so when the swing trainer is swung likea golf club the sensation of increased torque caused when centrifugal force acting on the weight overcomes the resistance offered by the coil spring causing the weight to slide down the shaft, can be detected in the arms of the person using the device whereby the person using the device learns the feel of a correct swing, and means for varying the magnitude of said weight slidably mounted on the shaft whereby the speed of the weight down the shaft can be varied when the trainer is swung, said means for varying the magnitude of said slidably mounted weight on the shaft comprising a sleeve formed from an elastic fabric covering the slidably mounted weight, the length of the sleeve larger than the length of said slidably mounted weight, and additional weights removably mounted in said sleeve embracing said shaft and held in said embrace by said elastic sleeve for increasing the magnitude of the slidably mounted weight on the shaft.

20. A golf club swing trainer for training arm muscles to improve a golf swing comprising a truncted golf club shaft, a weight slidably mounted on the shaft, a golf club handle formed on one end of the shaft, a limit stop on the shaft to limit the movement of the weight towards the handle, a stop at the end of the shaft remote from the handle, a coil spring for regulating the speed of the weight toward the end of the shaft remote from the handle when the swing trainer is swung mounted on the shaft, the ends of said coil spring abutting the stop on the end of the shaft and said weight, the resistance of the coil spring and the magnitude of the slidably mounted weight chosen so when the swing trainer is swung like a golf club, the sensation of increased torque caused when the weight slides down the shaft can be felt in the arms of the person using the trainer, whereby the person using the golf club swing trainer learns the feel of a correctly swung golf club, and means for varying the magnitude of the slidably mounted weight on the shaft whereby the speed of said weight down the shaft can be varied when the trainer is swung, said means for varying the the magnitude of said slidably mounted weight comprises a sleeve formed from an elastic fabric covering the slidably mounted weight, the length of the sleeve larger than the length of said slidably mounted weight, and additional weights removably mounted in said sleeve embracing said shaft and held in said embrace by said sleeve for increasing the magnitude of the slidably mounted weight on the shaft.

* * * * *